US007221860B2

(12) United States Patent
Fujimura et al.

(10) Patent No.: US 7,221,860 B2
(45) Date of Patent: May 22, 2007

(54) VACUUM INSULATED HEATER ASSEMBLY

(75) Inventors: Kensuke Fujimura, Euclid, OH (US); John Mariner, Avon Lake, OH (US)

(73) Assignee: Momentive Performance Materials Inc., Wilton, CT (US)

( * ) Notice: Subject to any disclaimer, the term of this patent is extended or adjusted under 35 U.S.C. 154(b) by 0 days.

(21) Appl. No.: 11/267,771

(22) Filed: Nov. 4, 2005

(65) Prior Publication Data

US 2006/0237441 A1 Oct. 26, 2006

Related U.S. Application Data

(60) Provisional application No. 60/674,100, filed on Apr. 22, 2005.

(51) Int. Cl.
*F24H 1/10* (2006.01)
*H05B 3/40* (2006.01)

(52) U.S. Cl. ..... 392/478; 392/465; 392/485

(58) Field of Classification Search ..... None
See application file for complete search history.

(56) References Cited

U.S. PATENT DOCUMENTS

| | | | |
|---|---|---|---|
| 6,257,320 | B1 | 7/2001 | Wargo |
| 6,516,143 | B2 | 2/2003 | Toya et al. |
| 6,845,732 | B2 | 1/2005 | Lim |
| 6,868,230 | B2 | 3/2005 | Gerhardinger |
| 2003/0127452 | A1 | 7/2003 | Gerhardinger et al. |

*Primary Examiner*—Thor S. Campbell
(74) *Attorney, Agent, or Firm*—Dominick G. Vicari

(57) ABSTRACT

A vacuum heater assembly for heating fluids flowing within; the assembly comprises an inner member having a heating surface with an average cross-sectional area with an aspect ratio of at least 2. The inner member is disposed within an outer member and with a vacuum drawn in the space between the inner member and the outer member, the heat transfers toward the center of the inner member, heating the fluids flowing within.

30 Claims, 4 Drawing Sheets

FIGURE 5
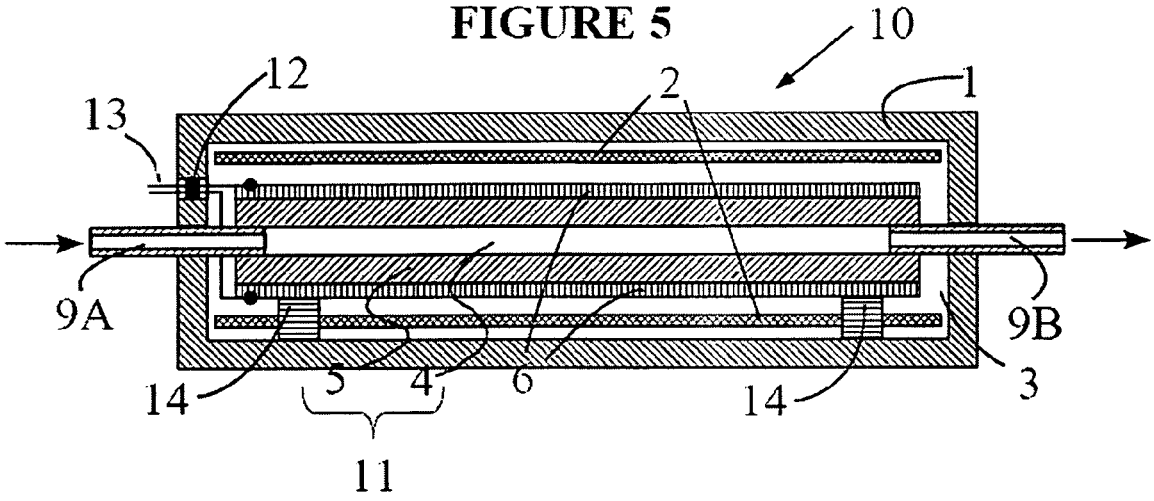
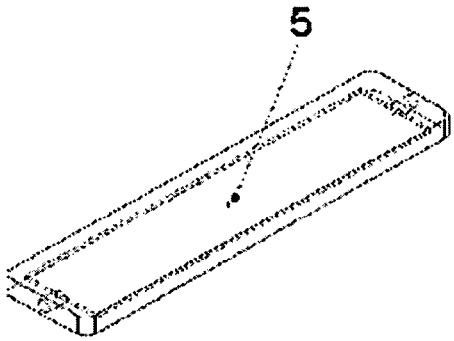
FIGURE 6
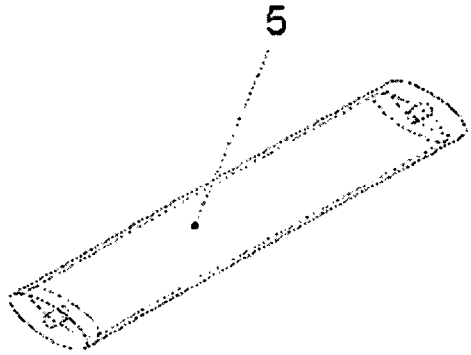
FIGURE 8

VACUUM INSULATED HEATER ASSEMBLY

CROSS-REFERENCE TO RELATED APPLICATIONS

This application claims the benefits of U.S. Provisional Patent Application Ser. No. 60/674,100 filed Apr. 22, 2005, which patent application is fully incorporated herein by reference.

FIELD OF INVENTION

The present invention is related to a vacuum heater assembly for heating fluids and objects.

BACKGROUND OF THE INVENTION

In certain processes such as chemical vapor deposition (CVD) with chemical reactions of gases inside a high temperature furnace, pre-heating of source gases during delivery to the furnace is often needed to maintain the source gases at a certain temperature. Those processes are typically highly sensitive to contamination, especially when they are used for semiconductor manufacturing or other nano-technologies. Heating elements in the equipment that easily react, corrode, or generate particles affect the source gases and consequently lower the yield of the end products. Those processes often require a clean room environment where the space to install apparatuses is limited as the room size is an important factor that determines the running cost. Among the apparatuses that provide such a function, downsizing and contamination reduction are common goals.

At elevated temperatures, most of commonly used metal materials become a potential source of metal contamination. In such an environment, the use of quartz to encase a heater element is known in the art to overcome the contamination problem. U.S. Pat. No. 6,868,230 discloses a vacuum insulated heater assembly, wherein the heating element or heater is a quartz glass tube. The vacuum effectively insulates the heating part from the environment and protects the heating element from oxidation. However, the prior art quartz tube heater is quite often bulky and not energy-efficient. The heat transfer through the channel wall of the passage is not the most efficient since, with the tubular flow passage implied in the prior art, the bulk of the flow passes near the center of the tube where the flow is the furthest from the heated surface in the passage.

There is still a need for an improved heater assembly, wherein the heating element is self-contained within the vacuum insulated heater assembly. The invention relates to an improved vacuum heater which is energy efficient, providing heat to the source gases in a range of laminar flow with reduced risk of contamination.

SUMMARY OF THE INVENTION

The invention relates to a heater assembly comprising: a) an inner member having a heating surface having at least two electrical contact leads for providing an electrical [deleted "series", path may be series or parallel electrical path added "resistance"] resistance path through said heating surface, said heating surface section having an average cross-sectional area with an aspect ratio of at least 2, said inner member having two end portions with each having at least a connection opening therethrough; b) an outer member having a non-tubular space enclosed within, with at least a connection opening therethrough; c) a supply pipe that connects through the connection openings in the end portions of the inner member and the outer member for providing a fluid to flow through; and wherein a vacuum is drawn in the space between said inner member and said outer member.

In one embodiment of the heater assembly, the heating surface section of the inner member has an average cross-sectional area with an aspect ratio of at least 4.

BRIEF DESCRIPTION OF THE DRAWINGS

FIG. 5 is a side view showing a cross section of an embodiment of the invention with heat reflectors disposed within the outer member.

FIG. 6 is a perspective view illustrating one embodiment of a heater assembly of the invention, having a flat elongated tube with rectangular cross section FIG. 8 is a perspective view of the heater of FIG. 7.

DETAILED DESCRIPTION OF THE INVENTION

As used herein, approximating language may be applied to modify any quantitative representation that may vary without resulting in a change in the basic function to which it is related. Accordingly, a value modified by a term or terms, such as "about" and "substantially," may not to be limited to the precise value specified, in some cases.

As used herein, the term "cross sectional area" refers a transverse area perpendicular to the direction of the flow of the fluids or objects to be heated.

Figure 4:
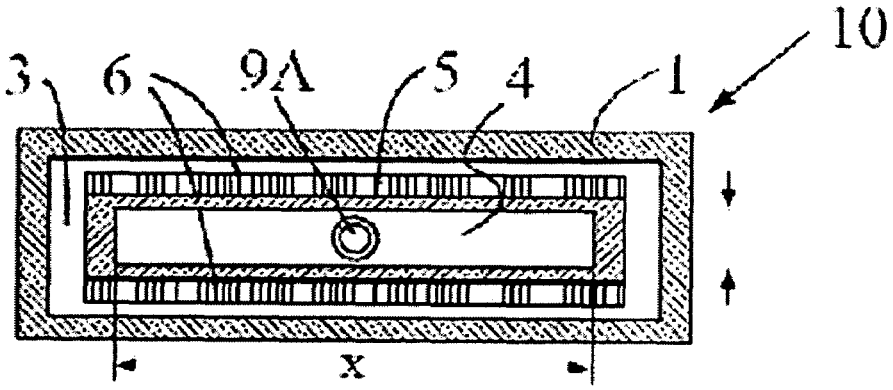
FIG. 4 is an end view showing a cross-section of an embodiment of the heater assembly, across the direction of the fluid flow.
Figure 7:
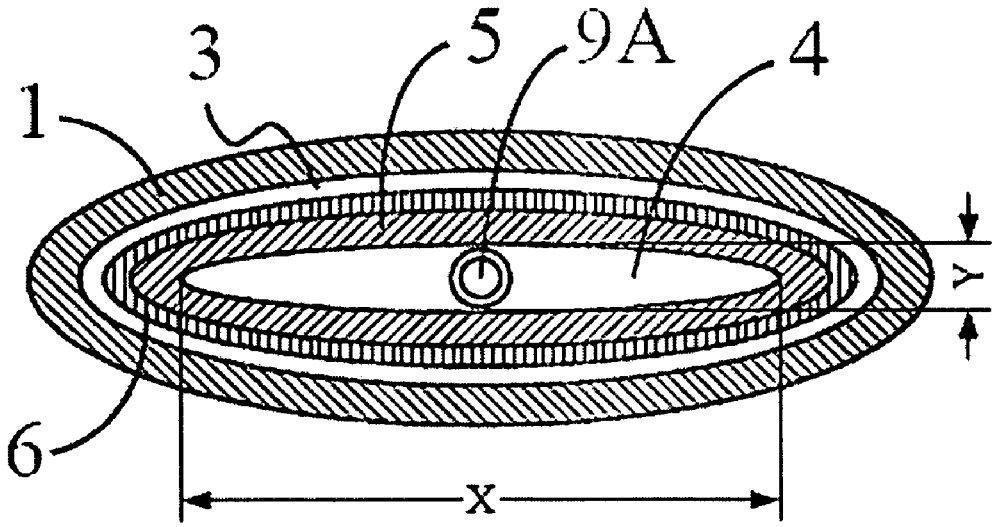
FIG. 7 is an end view showing a cross section of an embodiment of the invention, a flattened channel with elliptic cross section

The term "aspect ratio" refers the ratio of height and width of a cross sectional area of the flow channel, e.g., the ratio of X and Y shown in FIG. 4 and in FIG. 7. The width and the depth of the channel are interchangeable with each other and its aspect ratio is determined by whichever larger of the two divided by the other so that it is always greater than or equal to unity. For example, in a rectangular geometry, the "aspect ratio" is defined as the ratio of a long side length to a short side length of a rectangular geometry. In a circular/elliptical geometry, it is the ratio of a major diameter to a minor diameter.

As used herein, the term "heater surface" is used interchangeably with "heating element" or "heater surfaces" or "resistive heaters." The terms may be used in singular or plural form, indicating one or multiple items can be used.

In general, the invention relates to a heater assembly for heating fluids in semiconductor processing operations such as chemical vapor deposition (CVD) for thin film depositions, an etching system, an oxidation furnace, etc. In one aspect of the invention, fluids enter the heater assembly at a low temperature, e.g., ambient temperature, and leave the assembly heated, i.e., at>350° C. The fluids or objects to be heated can be of various forms, liquid, gases, etc. Examples include typical CVD gases such as silane (SiH4), ammonia (NH3), and nitrous oxide (N2O), etc., or inert gases such as helium, argon, and the like, for applications or processes other than CVD.

Generally, the heater assembly of the invention comprises an inner member and an outer member. Vacuum is drawn in the delimiting space between the inner member and the outer member of the heater assembly and forms thermal insulation. The heat generated by the heating element transfers toward the center of the heater assembly for heating fluid passing through and within a heating section of the inner member. In the heater assembly of the invention, the channel wherein fluids or objects to be heated flow through has a cross sectional area with an aspect ratio of at least 2, for effective convection heating of the fluid flowing within.

In one embodiment, the outer member has a shape similar to the inner member to minimize the size of the assembly. For embodiments wherein the inner member has high aspect ratio, an outer member with a tubular mismatched shape forms extra space between the inner member and the outer member, for an unnecessarily bulky assembly.

Figure 1:
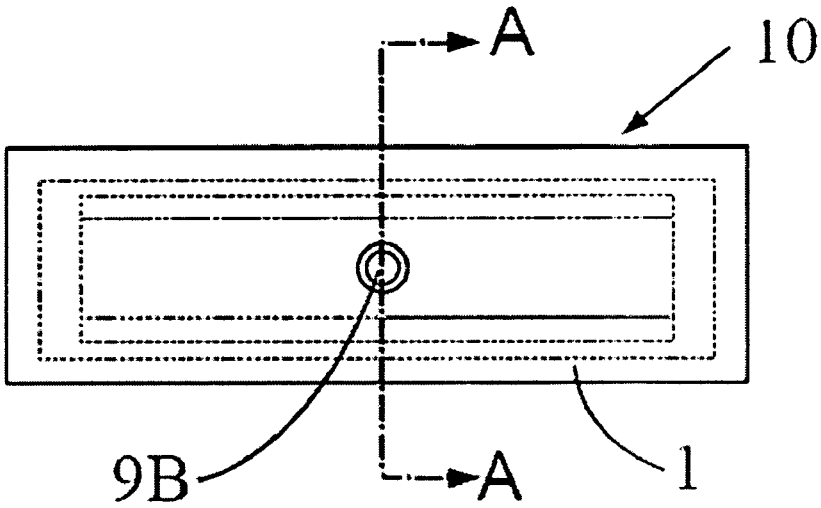
FIG. 1 is an end view showing an embodiment of the invention.

FIG. 1 is an end view of one embodiment of the heater assembly 10 of the present invention, wherein the processing fluid exits through outlet 9B.

Figure 2:
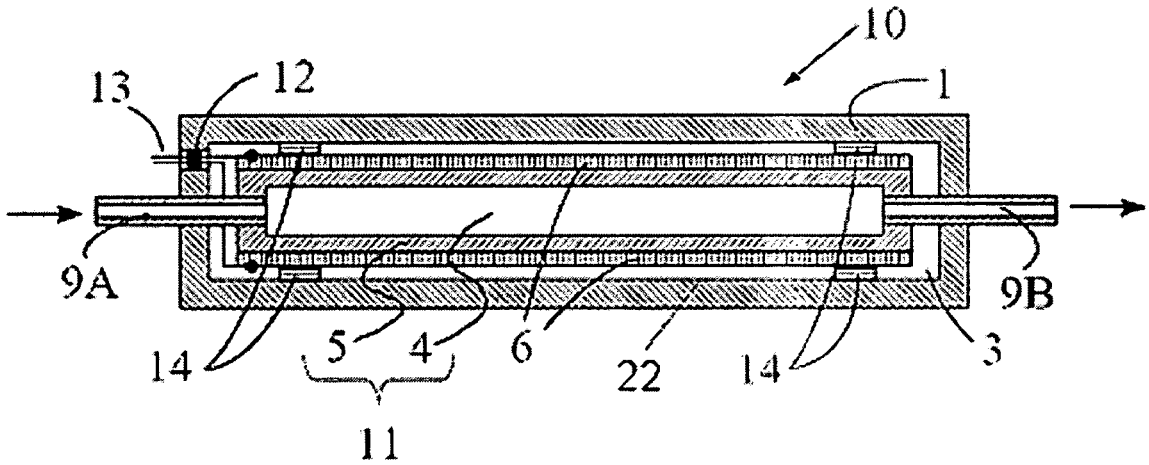
FIG. 2 is a side view showing a cross-section taken in the direction of the fluid flow in an embodiment of a heater assembly (along section line A—A of FIG. 1), wherein the fluid flows through a supply pipe into the inner member and then out of the outlet at the other end portion of the outer member.

FIG. 2 is a side cross-sectional view illustrating one embodiment of heater assembly 10, taken in the direction of the arrows along the section line A—A of FIG. 1. In the Figure the heater assembly 10 comprises an outer member 1, a plurality of heating elements 6, and an inner member 11. The inner member further comprises an elongated channel 4 enclosed in the channel wall 5. Supply pipe 9 extends through openings in the outer member 1, for a straight passage connection to the inner member 11. The inner member 11 is affixed to a plurality of support brackets 14 which in turn are affixed to the outer member 1. The support brackets 14 comprises a heat resistant material and preferably have low thermal conductivity to minimize conduction heat loss through the outer member 1, e.g. quartz glass, or a ceramic like aluminum oxide, etc. The supply pipe 9 connects the inner member 11 to a process gas supply (through inlet 9A) for delivery of processing fluid to be heated therethrough (exiting at outlet 9B). Electrical feedthrough 12 is fitted and hermetically sealed into the outer member 1 to supply electrical power to the heating elements 6 through the electrical connection member 13, e.g. molybdenum wire. Vacuum void space 3 delineates the space area wherein vacuum is drawn between the heating elements 6 and outer member 1. The vacuum void space 3 is to protect the heating elements 6 from oxidation at elevated temperatures while providing effective thermal insulation to minimize convection and conduction heat loss through the outer member 1 to the environment.

In one embodiment, the inner surface 22 of the outer member 1 has high reflectivity for the radiated heat from the heating elements 6 so that it reflects the radiated heat back towards the inner member 11. In other words, the high reflectivity on the inner surface 22 of the outer member 1, together with the vacuum void space 3, provides thermos bottle type of thermal insulation.

In the apparatus shown in FIG. 2, fluids or objects are brought into the elongated channel 4 through the supply inlet pipe 9A. The fluids or objects are heated as passing through the elongated channel 4, mainly by convection and/or conduction from the channel wall 5. The channel wall 5 is heated mainly by conduction and/or radiation from the heating element 6 disposed within the outer member 1. The heated fluids/objects then flow out of the assembly 10 through the supply outlet pipe 9B.

In one embodiment, the elongated channel 4 is enclosed in channel wall 5 in the form of a quartz glass tube, having resistive heater wires running around the tube for heating the fluids/objects inside the channel 4. In another embodiment as illustrated in FIG. 2, the heating element is in the form of planar resistive heaters 6, resting on and/or affixed to at least two sides of channel wall 5.

In yet another embodiment (not shown), the elongated channel is in the form of a tube, being fully enclosed by at least a heating element affixed thereon. In one embodiment, the heating element comprises a plurality of resistive heaters in the form of plates or disks affixed onto the outer surface of the inner member 11. In another embodiment, the heating element comprises a resistive heater having a geometry conforming to the inner member 11, e.g., in the form of a pipe or a tube fully enclosing the inner member 11.

In one embodiment, in addition to or in place of using resistive heater, the heating element is via other heating means known in the art, including eddy current heating, conduction heating, radiation heating from lump or other means, inductive heating, microwave heating, and the like.

In one embodiment, thermal interface material (not shown) may be sandwiched between the elongated channel 4 and the heating elements 6 to improve conductive heat transfer from the heating element 6 to the channel wall 5. The thermal interface material can be in the form of solid or liquid, being able to withstand the elevated temperatures of the heating elements 6. In one embodiment, the thermal interface material has a thermal resistivity of less than 50° C.-$cm^2$/W or less. e.g., ductile graphite sheet eGraf® available from Graffech International Ltd. of Wilmington, Del. In another embodiment, the thermal interface material comprises a solid sheet or foil having Young's modulus less than 70 GPa and a thermal conductivity greater than 1.5 W/mK. In yet a third embodiment, the material is a thermal grease containing at least one of a metal oxide, a metal nitride, and mixtures thereof. In a fourth embodiment, it is a thermal adhesive layer commercially available from Loctile, Robert Bosch GmbH, etc., for affixing the heating element to the inner member.

Figure 3:
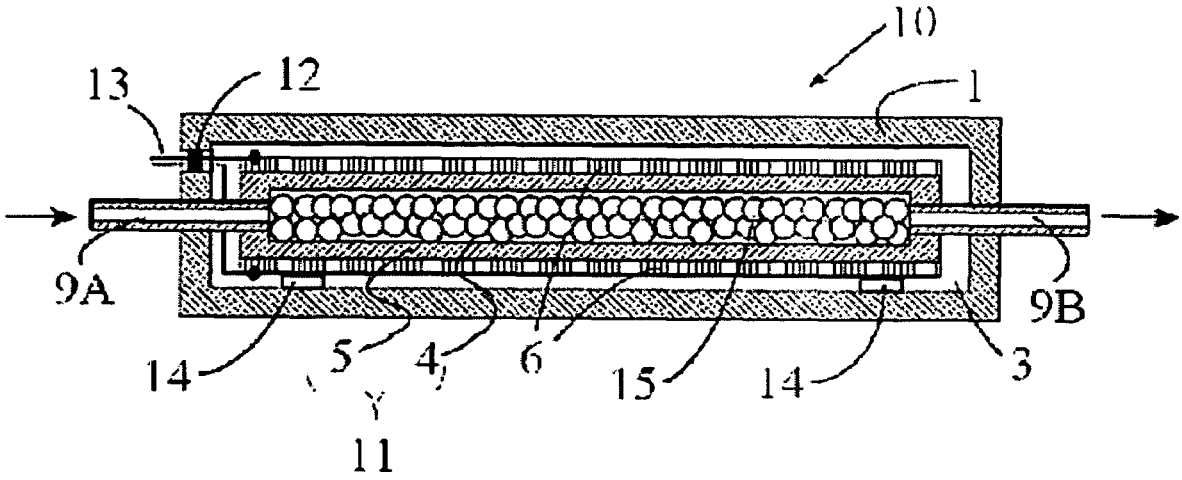
FIG. 3 is a side view showing a cross section of a second embodiment of the invention wherein its channel is filled with beads for heat transfer enhancement.

In one embodiment of the invention as shown in FIG. 3, the elongated channel 4 is a packed bed filled with beads or shapes 15 made of a non-contaminating material and of different shapes. Examples include balls, porous blocks, twisted tubes, pipes, tubes, beads, molded shapes made with quartz or ceramic. In one embodiment, the packed bed is filled with beads of different sizes, e.g., large and small of sizes ranging from 4 to 12 mm and a length of 4 to 10 mm. In another embodiment (not shown), the quartz beads are welded together forming a molded matter so that risk of quartz particle generated by rubbing is minimized. In one embodiment, the beads are in the form of glass pipes having an outside diameter of about 8 mm and an inside diameter of about 6 mm. The flat geometry of the elongated channel 4 of the invention provides an added advantage together with the beads 15, in improving the heat transfer coefficient over the common tubular geometry seen in prior arts.

In one embodiment (not shown), the elongated channel 4 is provided with a plurality of generally parallel fins integrally formed with and extending from the inside surface of inner member 5, with the fins being positioned at a slanted angle to facilitate the flow of the fluid through the channel 4. In another embodiment (not shown), the inner surface of channel wall 5 is extended by vertically oriented corrugated sheets of material, having corrugations extending downward and in the direction of the fluid flow to facilitate the flow of the fluid as well as increase the heating surface area.

In one embodiment of the invention with a flat geometry, the quartz glass beads, including the ones near the center of the elongated channel 4 can be effectively heated by adjacent heated channel wall 5 and hence effectively transfer the heat to the target fluids/objects, allowing the downsizing of the apparatus by shortening the required length of the elongated channel 4. In another embodiment, the elongated channel 4 may be filled with a packed bed, porous block, or extended fins extending from the channel wall 5 (not shown in Figures).

FIG. 4 is a cross-section view of one embodiment of the invention, taken across the direction of the flow of the fluid. In the Figure, vacuum void space 3 delineates the space area wherein vacuum is drawn between the heating element 6 and outer member 1. In one embodiment, the vacuum void 3 is preferably evacuated and hermetically sealed by a bonding technology such as fusion bonding at the time of manufacturing to minimize required maintenance. In another embodiment, vacuum grommets (not shown) may be used to seal and maintain the vacuum in the assembly.

In one embodiment of the invention, the inner surface of the outer member 1 is provided with a reflective surface. The heat reflector maybe disposed within the outside member 1, forming a reflective surface within the cavity. In one embodiment as shown in FIG. 5, a heat reflector 2 is disposed within the vacuum void space 3. The heat reflector is used to minimize heat losses through the body by reflecting radiated heat back toward the center of the cavity. In one embodiment, the heat reflector 2 comprises a single layer. In another embodiment, the heat reflector 2 may comprise multiple layers, or several pieces combined to form a unified body. For example, multiple layers of thin metal foil can provide effective reflection back towards the inner member 11.

The heat reflector 2 may be attached to the inner surface of the outer member 1 using several methods such as bonding to the inner surface with pressure sensitive adhesives, ceramic bonding, glue, and the like, or by fasteners such as screws, bolts, clips, and the like. In another embodiment, the reflective surface may be in the form of coating on the surface by means of painting, spraying, and the like. Alternatively, the reflective surface can be deposited on the inner surface of the outer member 1 using techniques such as electroplating, sputtering, anodizing, and the like. In one embodiment, the reflective surface is a film or sheet which covers the whole inner surface of the out member 1. In another embodiment, the inner surface is plated with aluminum, nickel, gold, or other metal surfaces adapted to reflect heat.

In one embodiment as shown in FIG. 6 showing a perspective view of the channel wall 5 and in FIG. 4 showing a cross-section of the assembly 10, the channel 4 has a relative flat shape with the cross-section area being rectangular in shape, enclosed in planar channel wall 5 and planar resistive heaters 6.

In one embodiment as shown in FIGS. 7 and 8, the elongated channel 4 is of a relatively flat or a "squashed" curved shape meaning that it has high aspect ratio along the cross-section of the channel. In FIG. 7, the cross sectional area 4 being oval or elliptical in shape, with the channel wall 5 and heating element 6 being oval or circular in shape, e.g., a quartz glass tube heater. In yet another embodiment (not shown), the cross section area 4 is of a trapezoidal shape.

In one embodiment, the elongated channel 4 has an average aspect ratio of at least 2. The average aspect ratio is the average of the aspect ratio of the cross-sectional areas along the elongated channel 4. In a second embodiment, the elongated channel 4 has an average aspect ratio of at least 4. In a third embodiment, the elongated channel 4 has an average aspect ratio of at least 8. In a fourth embodiment, the average aspect ratio of the elongated channel 4 is at least 10.

In another embodiment (not shown), the elongated channel 4 is of a zig-zagging shape providing a tortuous path for the fluid flow, with the cross-sectional area 4 still being rectangular, oval, or elliptical in shape, but with increased length or residence time for the fluid to flow through the heated surface. Those relatively flat shapes of the elongated channel 4 keep the fluids/objects adjacent to the heated surface and enhance the heat transfer.

Figure 9:
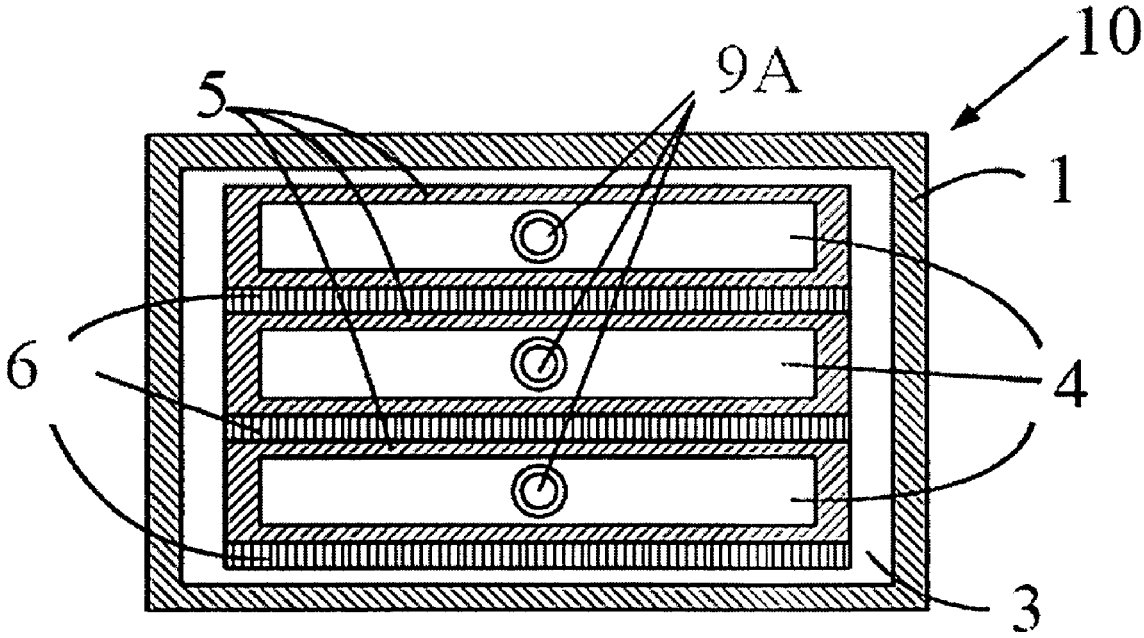
FIG. 9 is an end view showing a cross-section of another embodiment of the invention, for a heater assembly comprising an inner member with a multiple-channel flow.

FIG. 9 illustrates another embodiment of the heater assembly of the invention, with an elongated multi-channel section 4. As illustrated, the elongated channel 4 has multiple flow paths for the fluids to flow through and in between heater surfaces 6. It should be noted that the separate flow paths need not be of equal sizes, nor of equal distance from each other. Nor is there s a requirement for heater surfaces 6 to be provided for each flow path.

In one embodiment, the inner member 11 is formed of a ceramic material, such as aluminum nitride (AlN), aluminum oxide (Al2O3), cordierite, and the like. In one embodiment, all constructions/parts of the construction are made of the same ceramic material (e.g. quartz glass) and joined to each other by sintering means for a durable construction.

In one embodiment, the heating element 6 is in the form of a resistive heater, comprising a graphite or pyrolytic boron nitride (pBN) body, with a heating surface configured in a pattern for an electrical flow path defining at least one zone of an electrical heating circuit, and with a dielectric insulating coating layer encapsulating the patterned graphite or pBN body, comprising at least a material selected from the group consisting of a nitride, carbide, carbonitride or oxynitride of elements selected from a group consisting of B, Al, Si, Ga, refractory hard metals, transition metals, and combinations thereof. In one embodiment, the encapsulating layer comprises aluminum nitride or pyrolytic boron nitride.

In one example of a resistive heater as described in U.S. Pat. No. 5,343,022, the resistive heater comprises a pyrolytic boron nitride (pBN) plate as the substrate having a patterned pyrolytic graphite layer disposed thereon forming a heating element, and at least a coating layer encapsulating the patterned plate.

In another example of a resistive heater as described in U.S. Patent Publication U.S.20040074899A1, the heater comprises a graphite body configured in a pattern for an electrical flow path for a resistive heater, encapsulated in at least a coating layer comprising one of a nitride, carbide, carbonitride or oxynitride compound or mixtures thereof.

In yet another example of a heater as disclosed in U.S. Patent Publication No. U.S.20040173161A1, the heater comprises a graphite substrate, a first coating containing at least one of a nitride, carbide, carbonitride or oxynitride compound, a second coating layer of graphite patterned forming an electrical flow path for a resistive heater, and a surface coating layer on the patterned substrate, the surface coating layer also containing at least one of a nitride, carbide, carbonitride or oxynitride compound.

Heaters, resistance heating elements, or heating plates that can be used in the assembly of invention are commercially available from General Electric Company of Strongsville, Ohio, as BORALECTRIC™ heaters. Other heaters with excellent resistance to thermal shock under extreme conditions and fast thermal response rates, e.g., with heating rates>30° C. per second, can also be used.

In one embodiment, the outer member 1 may be of any material suitable for withstanding operating temperatures in the range of greater than 400° C. such as, for example, metals and composite materials such as aluminum, steel, nickel, and the like. The outer member 1 is further insulated by an exterior insulating cover. Pipes 9A and 9B may be provided with an exterior insulating cover as well.

In one embodiment, the electrical feedthrough 12 is made of molybdenum foil, strip, or wire sealed in quartz glass. A mechanically stable connection for the electrical feedthrough of the invention may be constructed in the manner as disclosed in U.S. Pat. Nos. 3,753,026; 5,021,711; and 6,525,475. In another embodiment, a quartz sealed molybdenum electrical feedthrough is fabricated with the use of quartz lumps.

Devices for pressure control of the fluid inlet, temperature control (for the resistive heaters), etc. typically employed for a heater assembly may also be used in conjunction with the assembly of the invention, although not shown in the Figures. In one embodiment, a temperature sensor is thermally coupled to the heating element to provide an indication of the temperature in the heater. In one embodiment, a point-of-use (POU) pump is used to pump down the assembly before the vacuum valve is open. The chamber assembly may also include a vacuum gauge with a range of ambient pressure to high vacuum, and a process manometer for controlling pressure of the vacuum chamber. In one embodiment, a provision is made for a Residual Gas Analysis (RGA) for photo-resist and other contaminant detection in the inner member of the assembly.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A heater assembly comprising:

a inner member comprising a thermally conductive material, having an inner surface and an outer face, the inner surface defining a channel for a fluid to be heated to flow through, the inner member having a flat geometry with a cross-sectional area in the flow direction of the fluid with an average aspect ratio of at least 2, the inner member having two end portions with at least a connection opening therethrough;

an outer member having two end portions, with at least a connection opening therethrough;

at least one heating element disposed between the inner member and the outer member;

a supply pipe that connects through the connection openings in the end portions of the inner member and the outer member for the fluid to flow through; and wherein a vacuum is drawn in the space between said inner member and said outer member.

2. The heater assembly of claim 1, wherein the heating element comprises at least a resistive heater.

3. The heater assembly of claim 2, wherein the heating element comprises a resistive heater having a geometry conformal to the outer surface of the inner member.

4. The heater assembly of claim 2, wherein the heating element comprises a plurality of resistive heaters being affixed to at least a portion of the outside surface of the inner member.

5. The heater assembly of claim 2, wherein the heating element comprises a substrate body having a heating surface configured in a pattern for an electrical flow path defining at least one zone of an electrical heating circuit and a dielectric insulating coating layer encapsulating the patterned substrate body.

6. The heater assembly of claim 5, wherein the encapsulating layer comprises at least a material selected from the group consisting of a nitride, carbide, carbonitride or oxynitride of elements selected from a group consisting of B, Al, Si, Ga, refractory hard metals, transition metals, and combinations thereof.

7. The heater assembly of claim 6, wherein the encapsulating layer comprises at least one of aluminum nitride and pyrolytic boron nitride.

8. The heater assembly of claim 1, wherein said inner member comprises a plurality of elongated channels, each having at least an inner surface defining a channel for a fluid to be heated to flow through.

9. The heater assembly of claim 1, wherein said inner member has an average cross-sectional area in the flow direction with an average aspect ratio of at least 4.

10. The heater assembly of claim 9, wherein said inner member has an average aspect ratio of at least 6.

11. The heater assembly of claim 10, wherein said inner member has an average cross-sectional area with an aspect ratio of at least 8.

12. The heater assembly of claim 1, further comprising at least a radiation reflector disposed within the outer member.

13. The heater assembly of claim 3, further comprising at least an electrical feedthrough for conducting electrical current to said resistive heater.

14. The heater assembly of claim 10 wherein the electrical feedthrough comprises molybdenum foil sealed in quartz glass.

15. The heater assembly of claim 1, further comprising a plurality of filler particles in the channel for increasing contact surface area for the fluid flowing through the channel.

16. The heater assembly of claim 15, wherein the filler particles are selected from beads, balls, blocks, tubes, pipes, molded shapes and combinations thereof.

17. The heater assembly of claim 16, wherein the filler particles comprise quartz glass beads.

18. The heater assembly of claim 1, wherein the inner surface of the inner member is extended by a plurality of corrugated sheets for expanding contact surface area for the fluid flowing through the channel.

19. The heater assembly of claim 2, further comprising a thermally conductive layer thermally coupling the resistive heater to the inner member.

20. The heater assembly of claim 19, wherein the thermally conductive layer comprises a solid sheet or foil having Young's modulus less than 70 GPa and a thermal conductivity greater than 1.5 W/mK.

21. The heater assembly of claim 19, wherein the thermally conductive layer comprises carbon.

22. The heater assembly of claim 19, wherein said thermally conductive layer comprises a thermal grease containing at least one of a metal oxide, a metal nitride, and mixtures thereof.

23. The heater assembly of claim 19, wherein said thermal interface material comprises an adhesive material for affixing the heating element to the inner member.

24. A heater assembly comprising:

a inner member comprising a thermally conductive material having an inner surface and an outer face, the inner surface defining a channel for a fluid to be heated to flow through, the inner member having a flat geometry with a cross-sectional area in the flow direction of the fluid with an average aspect ratio of at least 2, the inner member having two end portions with at least a connection opening therethrough, the outer surface having at least a flat portion;

an outer member having two end portions, with at least a connection opening therethrough;

at least one planar resistive heater disposed on the flat portion of the outer surface of the inner member;

a supply pipe that connects through the connection openings in the end portions of the inner member and the outer member for the fluid to flow through; and wherein a vacuum is drawn in the space between said inner member and said outer member.

25. The heater assembly of claim 24, wherein said planar resistive heater is a ceramic heater.

26. The heater assembly of claim 24, further comprising at least a radiation reflector disposed within the outer member.

27. The heater assembly of claim 24, further comprising a thermally conductive layer thermally coupling the planar resistive heater to the outer surface of the inner member.

28. The heater assembly of claim 24, wherein the heating element comprises a substrate body having a heating surface configured in a pattern for an electrical flow path defining at least one zone of an electrical heating circuit and a coating layer encapsulating the patterned substrate body.

29. The heater assembly of claim 28, wherein the encapsulating layer comprises at least a material selected from the group consisting of a nitride, carbide, carbonitride or oxynitride of elements selected from a group consisting of B, Al, Si, Ga, refractory hard metals, transition metals, and combinations thereof.

30. The heater assembly of claim 29, wherein the encapsulating layer comprises at least one of aluminum nitride and pyrolytic boron nitride.

* * * * *